United States Patent [19]

Snyder

[11] Patent Number: 4,693,411

[45] Date of Patent: Sep. 15, 1987

[54] COLLAPSIBLE BULK SHIPPING CONTAINER

[75] Inventor: Teddy R. Snyder, Maumee, Ohio

[73] Assignee: OI Forest Products STS Inc., Toledo, Ohio

[21] Appl. No.: 873,929

[22] Filed: Jun. 13, 1986

Related U.S. Application Data

[63] Continuation-in-part of Ser. No. 859,957, May 5, 1986, Pat. No. 4,691,859.

[51] Int. Cl.[4] ..... B65D 5/35

[52] U.S. Cl. ..... 229/23 R; 229/41 B

[58] Field of Search ..... 229/23 R, 41 R, 41 B

[56] References Cited

U.S. PATENT DOCUMENTS

| | | | |
|---|---|---|---|
| 2,534,011 | 12/1950 | Frye | 299/23 R |
| 4,101,052 | 7/1978 | Dove | 229/41 R |
| 4,411,373 | 10/1983 | Kupersmit | 229/41 R |

FOREIGN PATENT DOCUMENTS

| | | |
|---|---|---|
| 1063522 | 8/1859 | Fed. Rep. of Germany . |
| 25995 | 4/1907 | United Kingdom . |

OTHER PUBLICATIONS

Reprint from Nov. 19, 1983 edition of Food Processing entitled "Incoming Shipments of Raw Products Packed in Corrugated Fibre Bins."

*Primary Examiner*—Willis Little

*Attorney, Agent, or Firm*—H. G. Bruss

[57] ABSTRACT

A collapsible, bulk shipping container that is made up of an inverted tray-type rectangular bottom and a pair of collapsible body elements, one end of each of which is telescopically received in the tray-type bottom. The collapsible body elements collectively form the body of the container and each is collapsible from a fully open position, in which they cooperate to form the container body and fill the tray-type bottom, into a collapsed condition in which the first lies against one side of the tray-type bottom, and the second lies in superimposed relationship on the first collapsible body element, each collapsible body element being secured to one side of the tray-type bottom. When the collapsible body elements have been collapsed, they can be folded over to lie in superimposed relationship above the tray-type bottom in a compact configuration for ease of the shipment or storage of the bulk shipping container. The tray-type bottom is preferably formed from a unitary blank of corrugated fiberboard, and each of the collapsible body elements is preferably formed from a sheet of corrugated fiberboard.

32 Claims, 12 Drawing Figures

COLLAPSIBLE BULK SHIPPING CONTAINER

CROSS-REFERENCE TO RELATED APPLICATION

This application is a continuation-in-part of my copending application Ser. No. 859,957 filed on May 5, 1986 now U.S. Pat. No. 4,691,859.

BACKGROUND OF THE INVENTION

1. Field of the Invention

This invention relates to a collapsible corrugated fiberboard shipping container for shipping relatively large volumes and weights of materials in bulk. A container according to the present invention can be permanently attached to or placed on a conventional wood or plastic pallet or a slip sheet for use and reuse with such pallet or slip sheet, or it can be used and reused without an associated pallet or slip sheet.

2. Description of the Prior Art

Collapsible corrugated fiberboard containers have been proposed for use in the shipment of bulk materials, the collapsibility of such containers permitting the convenient return of such containers to the shipping point, after the emptying of the containers, to permit the reuse of such containers. The volume of such containers is frequently very large, which permits the packaging of large weights of bulk materials therein. Because the weight of the filled container can often be beyond the handling capabilities of the personnel who are engaged in the shipping or other handling of the filled container, it is usually necessary to design the container to be handled by means of a forklift truck. Thus, certain of such collapsible fiberboard containers are designed to be attached to a conventional wood or plastic pallet and to be shipped with the associated pallet in filled condition throughout the movement of the filled container, and to be shipped in collapsed condition with the associated pallet back to the shipping point to permit the reuse of the container. U.S. Pat. Nos. 4,373,637 (Shippell) and 3,291,364 (Fischer) describe collapsible, pallet mounted corrugated fiberboard shipping containers of the aforesaid type.

Frequently, however, it is desired to provide a collapsible corrugated fiberboard bulk shipping container which can be used independently of a plastic or wood pallet, to avoid the need for accommodating the weight and volume of the pallet in the return of the collapsed container for refilling and reuse. It is possible to mechanically handle a heavy, filled bulk container without having a pallet thereunder, by placing the container on a thin sheet of paper or other sheetlike material, known as a slip sheet, which readily permits a forklift truck tool to engage a free end of the slip sheet to permit the mechanical handling of the filled container. The use of such a slip sheet is described in U.S. Pat. No. 4,153,161 (Taylor, et al.). Collapsible, corrugated fiberboard bulk shipping containers which are designed to be used without associated pallets are shown, for example, in U.S. Pat. Nos. 4,405,077 (Kupersmit) and 4,252,266 (Kupersmit).

SUMMARY OF THE INVENTION

According to the present invention there is provided a collapsible reusable bulk shipping container which can be readily fabricated from singlewall, doublewall or triplewall corrugated fiberboard or from any other suitable foldable, sheetlike material, and which can be used in a form in which it is secured to a wood or plastic pallet, or to a slip sheet, or which can be used independently of such a pallet or such a slip sheet according to the wishes of the user. The bulk container according to the present invention, when erected, has the configuration of a parallelepiped, one surface, the top surface in the normal orientation of the container, being open to permit the filling and emptying of the container. This open top of the container can, of course, if desired, be closed by a separate inverted, tray-type closure which telescopes over the upper portion of the container, or the closure can be formed from flaps that are integrally attached to the container, but the design of such a closure can be conventional, and will not be further described herein.

In any case, the open top, parallelepiped container of the present invention is formed from three separate elements which are then joined together into the assembled collapsible container. The first of the elements is a special, shallow tray-type element which serves as the bottom of the container and which has a rectangular opening that faces upwardly when the container is in its normal orientation. Each of the second and third of the elements is a collapsible structure forming at least three sides of a quadrilateral configuration, the bottom portion of which is telescoped into the tray-type element. Each of the collapsible structures, when it is fully opened, has at least three sides, the outside of each of which is adapted to lie adjacent to and substantially coextensive with the inside of one of the sides of the shallow, tray-type element. The outside of one of the sides of the collapsible structure, the middle side in a three-sided colapsible structure, is adhesively or otherwise secured to the inside of the tray-type element that it is adjacent to, and the adjacent two sides of the collapsible structure float with respect to, or are unsecured to, the two sides of the tray-type element to which they are adjacent in the erected container. In one of the embodiments of the present invention, each collapsible structure is made up of a collapsible, four sided tubular structure, and each of the sides of such collapsible tubular structure that extends from an end of the side that is secured to the shallow, tray-type element is foldable along a vertical score line, to permit the collapsing of such sides by the inward folding thereof, an act which draws the free or floating fourth side of each such tubular structure toward the side that is secured to a side of the tray-type element.

Once collapsed, each of the second and third elements of the container of the present invention can be folded over from a vertical orientation in its erected condition to a horizontal orientation in its collapsed condition, and the dimensions of the sides of each of such second and third elements of the container may be such that each of such elements, when collapsed, will be in superimposed relationship to one another and in many cases will lie entirely within the periphery of the tray-type element in a neat, compact arrangement. Each of the second and third elements can be formed from a single sheet of corrugated fiberboard, and in one of the embodiments, each of such second and third elements is in its erected form, a three-sided, U-shaped element, the legs of which at least meet and, preferably, overlap to thereby define a four-sided tubular structure.

Accordingly, it is an object of the present invention to provide an improved collapsible bulk shipping container. More particularly, it is an object of the present invention to provide a collapsible bulk shipping container which can be used with or without an associated pallet according to the wishes of the user. It is also an object of the present invention to provide a reusable, collapsible, multiple component, open-top bulk shipping container which can be fabricated from three or more blanks of a simple configuration, each of which blanks can be formed of a suitable rigid, foldable sheet-like material, the components of such container being secured to one another to avoid disassociation of such components during the return of the collapsed container for reuse. It is also an object of the present invention to provide a collapsible, multi-component, reusable bulk shipping container, which container can be collapsed into a compact configuration that wastes little space during the transportation of such a container in its collapsed condition. It is also an object of the present invention to provide a collapsible bulk shipping container which self-divides itself into at least two cells.

For a further understanding of the present invention and the objects thereof, attention is directed to the drawings and the following detailed description of the preferred embodiment and to the appended claims.

DETAILED DESCRIPTION OF THE PREFERRED EMBODIMENT

Figure 1:
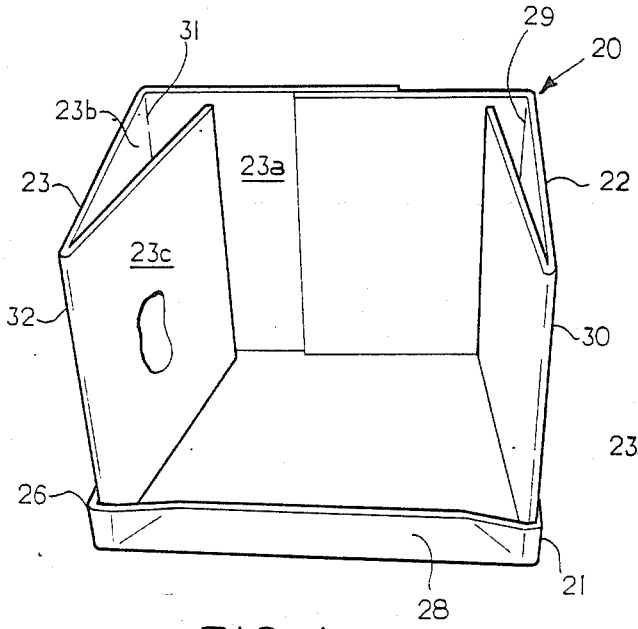
FIG. 1 is a perspective view of a preferred embodiment of a collapsible bulk shipping container in a partially erected state.
Figure 2:
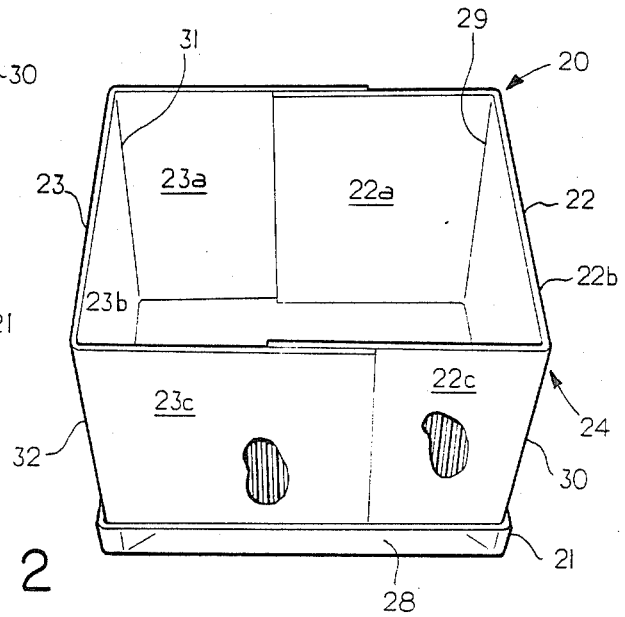
FIG. 2 is a view of the shipping container of FIG. 1 in its fully erected state.
Figure 3:
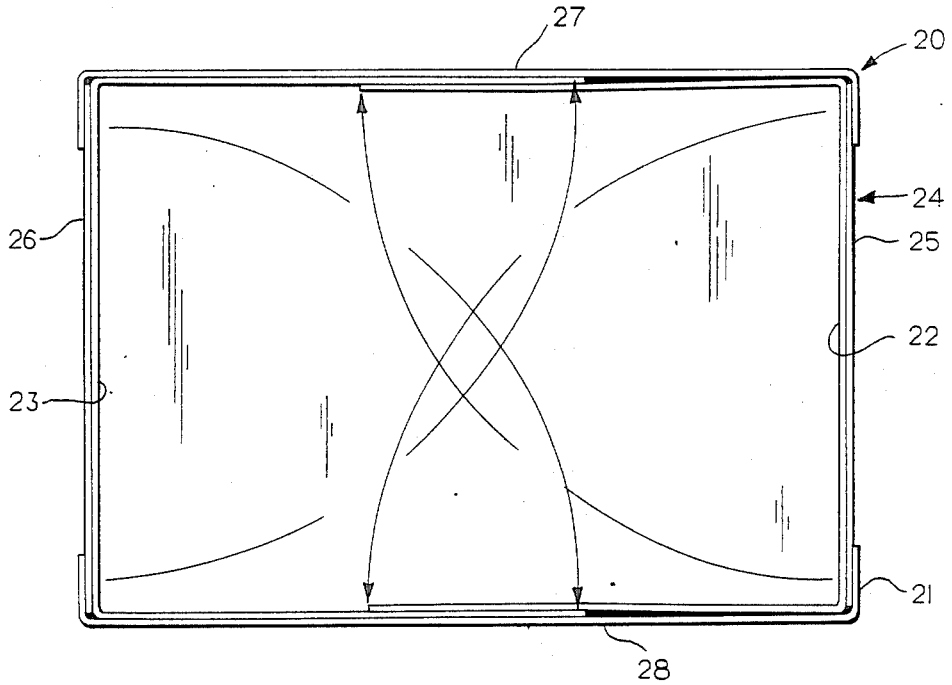
FIG. 3 is a plan view, at an enlarged scale, of the shipping container of the present invention as depicted in FIG. 2.

As is shown in FIGS. 1 through 3, a container according to the preferred embodiment of the present invention, identified generally by reference numeral 20, includes a bottom 21 in the form of a tray and first and second collapsible three-sided body elements 22 and 23 which, collectively, form a container body 24, the bottom portion of which is telescoped into the bottom 21. The bottom 21 of the container 20 is generally quadrilateral in configuration, preferably generally rectangular, and has a pair of opposed short sides 25 and 26 and a pair of opposed long sides 27 and 28, each of the long sides 27 and 28 extending between the opposed ends of the short sides 25 and 26.

Figure 5:
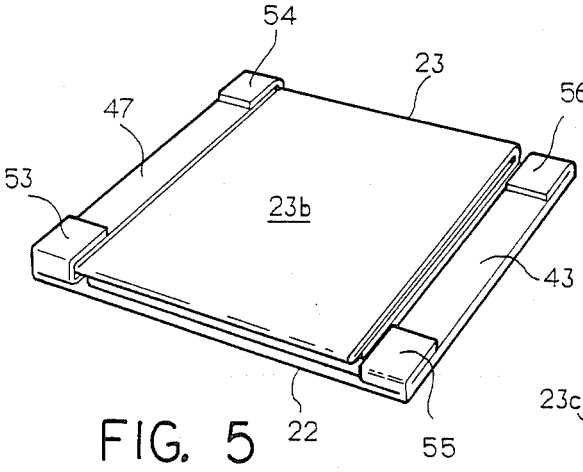
FIG. 5 is a perspective view of the shipping container of FIGS. 1 through 3 in its fully collapsed state.
Figure 6:
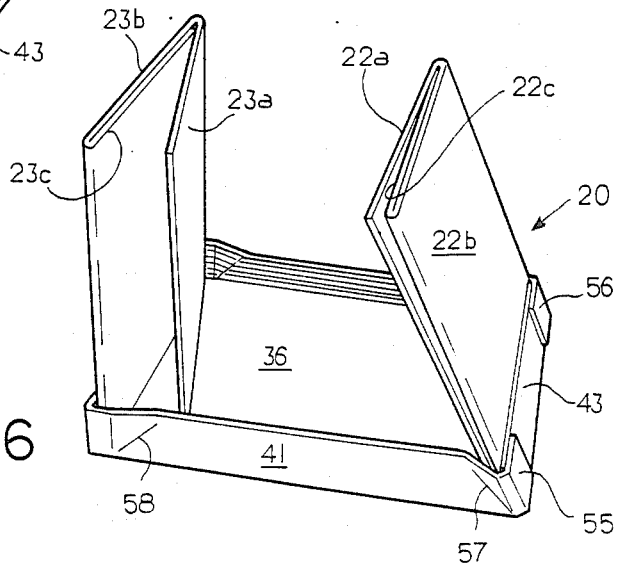
FIG. 6 is a perspective view of the shipping container in FIGS. 1 through 3 and 5 showing a stage in the erection of such shipping container from the fully collapsed state depicted in FIG. 5.

The first collapsible body element 22 is scored or otherwise deformed along first and second spaced apart vertical lines 29 and 30 to form a series of three panels **22*a*, 22*b* and 22*c* therein. Likewise, the second collapsible body element 23 is scored or otherwise deformed along first and second spaced apart vertical lines 31 and 32 to form a series of three panels 23*a*, 23*b* and 23*c* therein. The panels 22*a*, 22*b* and 22*c* are foldable with respect to one another to define a generally U-shaped configuration, as is shown in FIG. 2, when the container body 24 is in its erected condition, and to lie in superimposed relationship with respect to one another, as is shown in FIGS. 5 and 6, to permit the container body 24 to be collapsed for economy of space during the shipment or storage of the container 20 when it is empty. Likewise, the panels 23*a*, 23*b* and 23*c* are foldable with respect to one another to define a generally U-shaped configuration, when the container body 24 is in its erected condition, and to lie in superimposed relationship with one another to permit the container body 24** to be collapsed.

When the container body 24 is fully erected, the central panel **22*b* of the first collapsible body element 22 will be disposed next to, and will be substantially coextensive with, the first short side 25 of the bottom 21; the central panel 23*b* of the second collapsible body element 23 will be disposed next to, and will be substantially coextensive with, the second short side 26 of the bottom 21; the panels 22*a* and 23*a* of the first and second collapsible body elements 22 and 23 will be disposed next to the first long side 27 of the bottom 21, in partially overlapping relationship with one another; and the panels 22*c* and 23*c* of the first and second collapsible body elements 22 and 23 will be disposed next to the second long side 28 of the bottom 21** in partially overlapping relationship with one another.

The first collapsible body element 22 and the bottom 21 of the container 20 are permanently secured to one another along the first short side 25 of the bottom 21 by staples, not shown, or by the application of an adhesive, not shown, to the outside of the portion of the central panel **22*b* of the first collapsible body element 22 which is overlapped by the first short side 25 of the bottom 21 and/or by the application of an adhesive to the inside of the first short side 25 of the bottom 21, or in any other conventional manner. Similarly, the second collapsible body element 23 and the bottom 21 of the container 20 are permanently secured to one another along the second short side 26 of the bottom 21 by staples, not shown, or by the application of an adhesive, not shown, to the outside of the portion of the central panel 23*b* of the second collapsible body element which is overlapped by the second short side 26 of the bottom 21 and/or by the application of an adhesive to the inside of the second short side 26 of the bottom 21, or in any other conventional manner. The other panels 22*a*, 22*c*, 23*a*, and 23*c* of each of the first collapsible body element 22 and the second collapsible body element 23, are unsecured to, and are free to move or float with respect to, the sides of the bottom 21 that they are disposed next to, namely the first long side 27 in the case of the panels 22*a* and 23*a*, and the second long side 28 in the case of the panels 22*c* and 23*c***.

FIG. 1 illustrates the container 20 in which the tubular container body 24 is in a partially collapsed state, a state which also corresponds to a partially open state.

Figure 4:
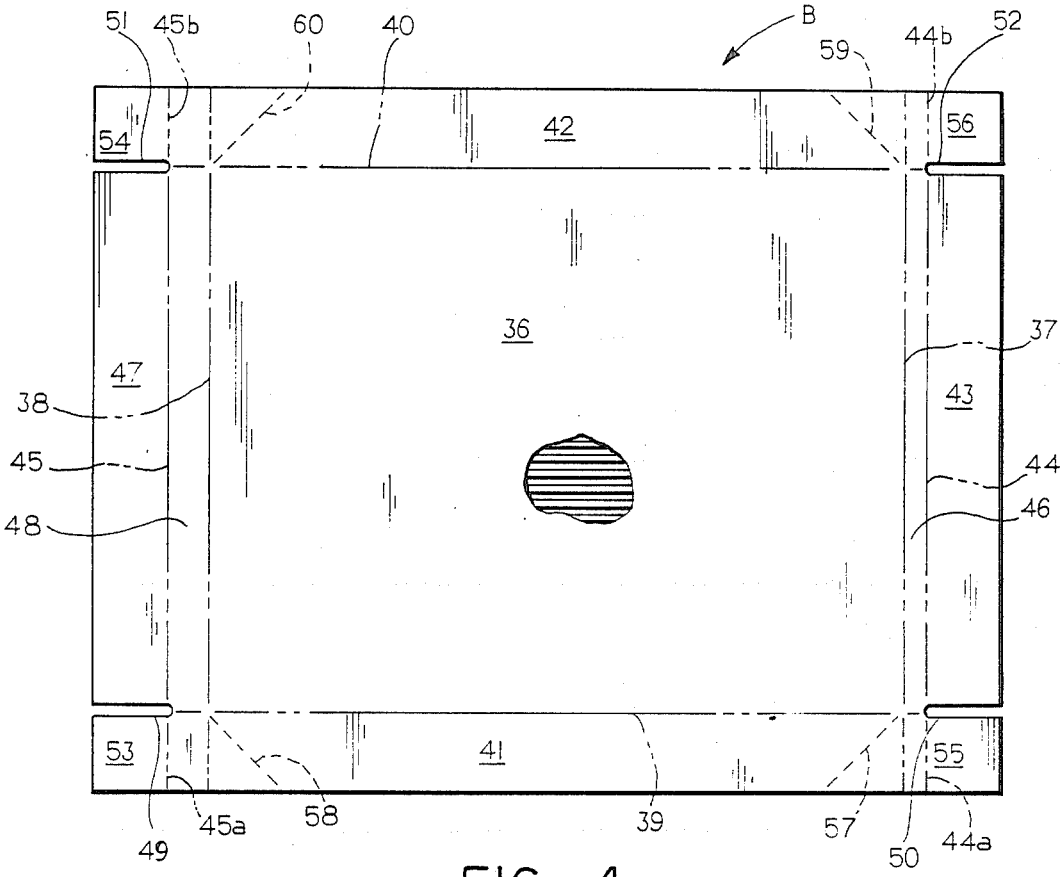
FIG. 4 is a plan view of the top of a blank for use in forming one of the elements of the shipping container depicted in FIGS. 1 through 3.

FIG. 4 illustrates a special blank B from which the bottom 21 of the container 20 is formed. The blank B has a rectangular panel 36 which forms a horizontally disposed lowermost portion of the bottom 21 of the container 20. The rectangular panel 36 is disposed generally centrally within the outline of the blank B, which also is generally of rectangular configuration, and the rectangular panel 36 is separated from the remaining portions of the blank B by fold lines 37 and 38 along the short sides of the rectangular panel 36 and by fold lines 39 and 40 along the long sides of the rectangular panel, the fold lines 37, 38, 39 and 40 being formed by deforming the blank B by scoring, slit scoring or otherwise, as is known in the art. By the scoring of the blank B along the fold lines 39 and 40 there is formed therein first and second long side panels 41 and 42, respectively. The blank B is also scored along a fold line 44 which is spaced from and extends parallel to the fold line 37, the fold line 44 forming a first short panel 43 and a first intermediate panel 46 between the fold line 37 and the fold line 44. Similarly, the blank B is scored along a fold line 45 which is spaced from and extends parallel to the fold line 38, the fold line 45 forming a second short panel 47 and a second intermediate panel 48 between the fold line 38 and the fold line 45. The blank B is also cut or slotted along the extensions beyond fold lines 39 and 40 that lie beyond the ends of the rectangular panel 36 to form cuts or slots 49 and 50 at the ends of the fold line 39 and cuts or slots 51 and 52 at the ends of the fold line 40. While the cuts or slots 50 and 52 are shown as extending only from the free edge of the blank B to the fold line 44, it is preferable in certain embodiments of the invention for them to extend to the fold line 37. Similarly, while the cuts or slots 49 and 51 are shown as extending only from the free edge of the blank B to the fold line 45, it is preferable in certain embodiments of the invention for them to extend only to the fold line 38. In any case, the blank B is also scored along the extensions of the fold line 44 beyond the cuts or slots 50 and 52, as shown at 44*a* and 44*b*, respectively, and corner locking flaps 55 and 56 are formed in corners of the blank B by the cut or slot 50 and the fold line extension 44*a*, and by the cut or slot 52 and the fold line extension 44*b*. Thus, the first short side 25 and the first and second long sides 27 and 28 of the bottom 21 of the container 20 are formed by folding the first long side panel 41 and the second long side panel 42 to extend normally with respect to the rectangular panel 36, by folding the first short panel 43 to extend normally with respect to the intermediate panel 48, by inwardly folding the corner locking flaps 55 and 56 to overlie the end portions of the first short panel 43, and by securing the corner locking flaps 55 and 56 to the portions of the first short panel 43 by an adhesive or by staples, not shown.

The fold line 45 is also scored along the extension 45*a* and 45*b* which lie beyond the cuts or slots 49 and 51, thereby forming corner locking flaps 53 and 54 in the other corners of the blank B by the fold line extension 45*a* and the cut or slot 49, and by the fold line extension 45*b* and the cut or slot 51, respectively. Thus, the second short side 26 of the bottom 21 of the container 20 is formed by folding the second short panel 47 along the fold line 45 to extend normally with respect to the second intermediate panel 48, by inwardly folding the corner locking flaps 54 and 55 to overlie the end portions of the second short panel 47 and by securing the corner locking flaps 53 and 54 to the portions of the second short panel 47 by an adhesive or by staples, not shown.

The space between the fold line 37 and the fold line 44 is, preferably, slightly greater than the collapsed thickness of the first collapsible body element 22 of the container 20 so that the end area of the collapsed first collapsible body element 22 can be contained entirely within the outline of the first intermediate panel 46. This will permit the collapsed first collapsible body element 22 and the first intermediate panel 46 to be folded along the fold line 37 to lie along the rectangular panel 36 of the bottom 21 of the container 20. further, the space between the fold line 38 and the fold line 45 is, preferably, slightly greater than the combined collapsed thickness of the first collapsible body element 22 and the second collapsible body element 23 of the container 20 so that the combined end areas of the collapsed first collapsible body element 22 and the collapsed second collapsible body element 23 can be contained entirely within the outline of the second intermediate panel 48. This will permit the collapsed second collapsible body element 23 and the second intermediate body panel 48 to be folded along the fold line 38 to lie along the collapsed first collapsible body element 22 of the container 20 to permit the container 20 to be collapsed in a neat, compact configuration, as is shown in FIG. 5, for ease of storage and shipment to the packing plant for the first use threof or, in the case of a reusable container 20, for the return shipment for reuse thereof. For optimum collapsibility the first long side panel 41 is provided with first and second diagonal fold lines 57 and 58 extending, respectively, from the fold lines 37 and 38 in a converging manner at a 45° angle to the fold line 39 to the nearby free edge of the blank B, the diagonal fold lines 57 and 58 preferably being formed in the underside of the blank B, and, similarly the second long side panel 42 is provided with first and second diagonal fold lines 59 and 60 extending, respectively, from the fold lines 37 and 38 in a converging manner at a 45° angle to the fold line 40 to the other edge of the blank B, the diagonal fold lines 59 and 60 also, preferably, being formed in the underside of the blank B. The diagonal fold lines 57 and 58 permit the portion of the first long side panel 41 between such diagonal fold lines to be folded inwardly to overlie the rectangular panel 36 when the container 20 is collapsed, and, similarly, the diagonal fold lines 59 and 60 permit the portion of the second long side panel 42 therebetween to be folded inwardly to overlie the rectangular panel 36 when the container 20 is collapsed, as is clear from FIG. 6.

The container 20 can be used with a standard wood or plastic pallet, not shown, for example, by stapling the rectangular panel 36 of the bottom 21 of the container 20 to such pallet or simply by placing or strapping the containers on such pallet. However, the container 20 is not restricted to use with a pallet even in the case of a large container that is adapted to contain heavy loads, for example, a container whose short sides 25 and 26 are each 40" and whose long sides 27 and 28 are each 48", a container size which would be well-suited for use with a standard 40"×48" pallet, because such a container could be handled by standard forklift handling equipment, without being attached to a pallet, for example, by inserting a slip sheet (not shown) thereunder, as is known in the art. While the container 20 as heretofore described has an open top, such open top can, of course, be closed by a separate inverted, telescoping tray-type cover or other cover, not shown, as is known in the art, or it can be closed by flaps that are integrally attached to the first and second collapsible body elements 22 and 23, respectively, as is also known in the art. The blank B and the first and second collapsible body elements 22 and 23 of the container 20 are each preferably formed from a heavy load bearing grade of corrugated fiberboard, for example, from heavy singlewall corrugated fiberboard or, preferably, for large containers, such as pallet size 40"×48" containers, from doublewall corrugated fiberboard or even, in certain cases, from triplewall corrugated fiberboard especially if such large containers are designed to be reusable. Of course, the bottom 21 of the container 20 and the first and second collapsible body elements 22 and 23 thereof experience different loads in service. Hence, the grade of corrugated fiberboard that is used in the blank B is not necessarily the same as the grade that is used in the first and second collapsible body elements 22 and 23.

Figure 7:
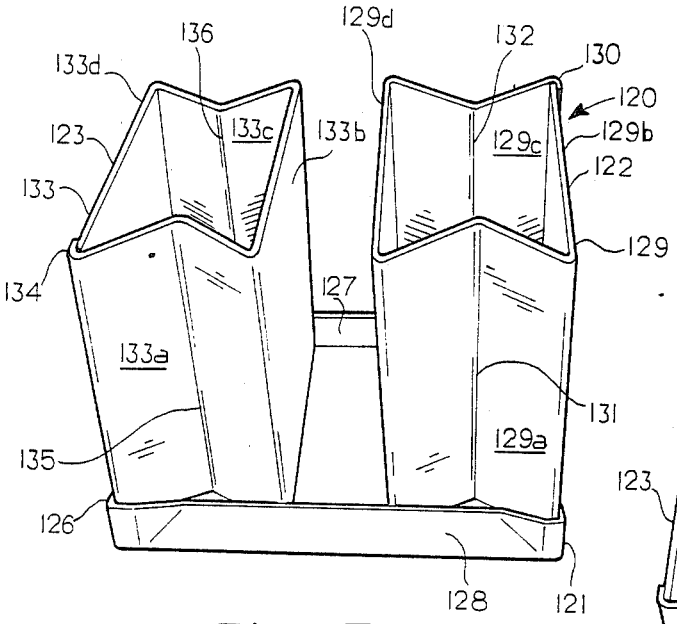
FIG. 7 is a view similar to FIG. 1 showing an alternative embodiment of a collapsible bulk shipping container in a partially erected state.
Figure 8:
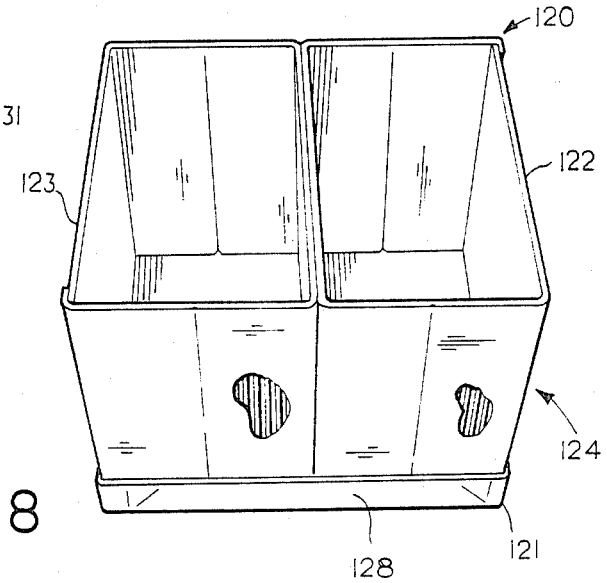
FIG. 8 is a view similar to FIG. 2 of the shipping container of FIG. 7.
Figure 9:
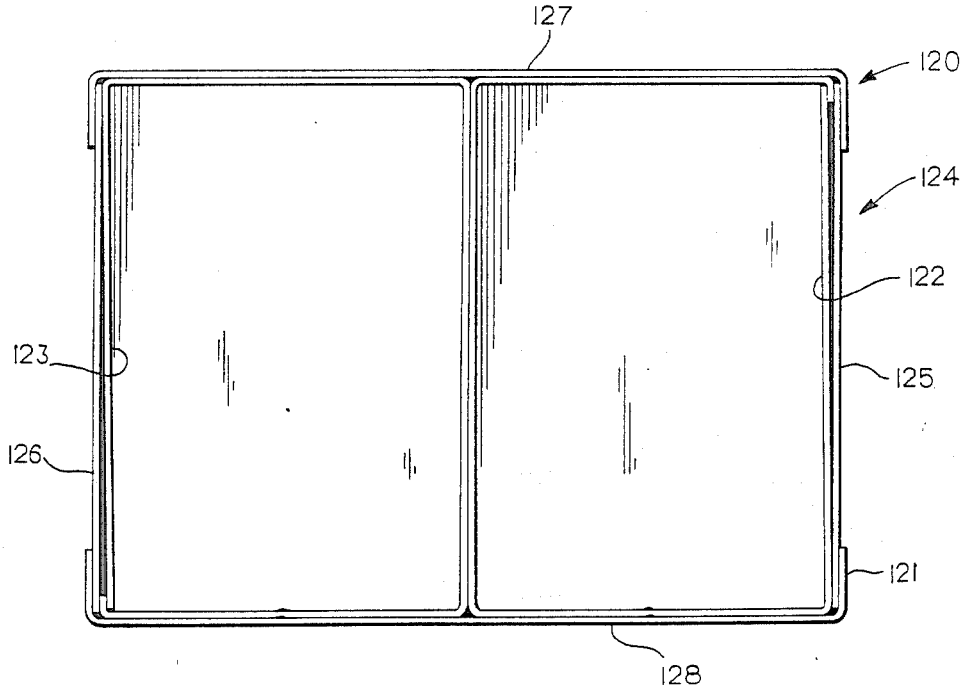
FIG. 9 is a view similar to FIG. 3 of the shipping container of FIG. 8.

As is shown in FIGS. 7 through 9, an alternative embodiment of a container according to the present invention, identified generally by reference numeral 120, includes a bottom 121 in the form of a tray and first and second tubular bodies 122 and 123, the bottom portion of each of which is telescoped into the bottom 121. The first tubular body 122 and the second tubular body 123, thus, cooperate to form a partitioned container body 124 with one another, such container body having two cells therein. In any case, as illustrated, each of the cells formed by the first tubular body 122 and the second tubular body 123 is substantially equal in size, and it is contemplated that, on occasion, it may be desirable to utilize a container in which the cell that is formed by one or another of the first tubular body 122 or the second tubular body 123 is substantially larger than the other. The bottom 121 of the container 120 is generally quadrilateral in configuration, preferably generally rectangular, and has a pair of opposed short sides 125 and 126 and a pair of opposed long sides 127 and 128, each of the long sides 127 and 128 extending between the opposed ends of the short sides 125 and 126.

Figure 11:
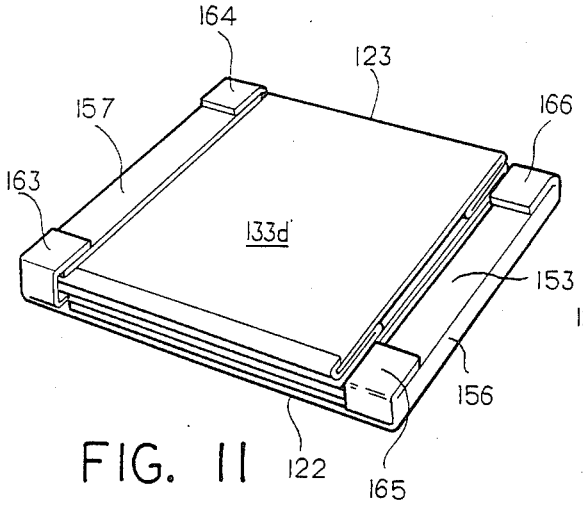
FIG. 11 is a view similar to FIG. 5 of the shipping container of FIGS. 7 through 9.
Figure 12:
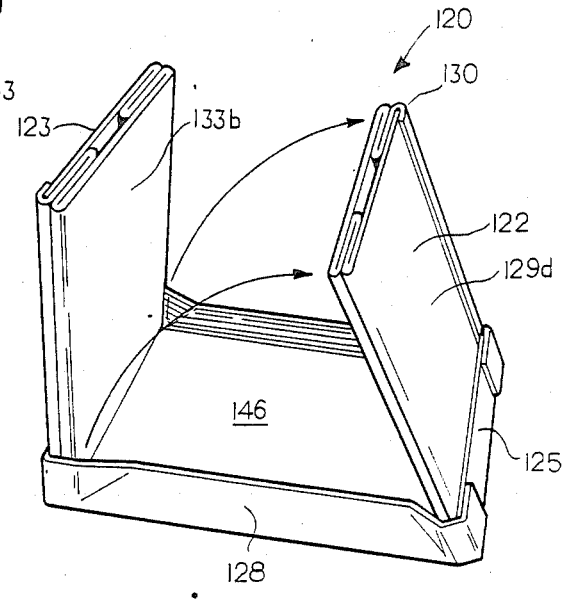
FIG. 12 is a view similar to FIG. 6 of the shipping container of FIGS. 7 through 9 and 11.

The first tubular body 122, in the illustrated embodiment, is formed from a first sheetlike piece 129 joined end to end, with an overlapped joint 130 between the joined ends of the piece 129. The first sheetlike piece 129 is scored or otherwise deformed along a pair of vertical lines 131 and 132 in opposed sides thereof to permit it to be collapsed upon itself as is shown in FIGS. 11 and 12, the sheetlike piece 129 also being scored or otherwise deformed along vertical lines at its corners to permit it to be formed into the illustrated tubular configuration. When the first tubular body 122 is fully erected, as is shown in FIG. 8, its configuration in a horizontal plane is generally rectangular with an opposed pair of short sides **129*a* and 129*c*, respectively, the sides which, respectively, contain the vertical lines 131 and 132, and with an opposed pair of long sides 129*b* and 129*d*, respectively. When the first tubular body 122 is fully erected, the long side 129*b* of the sheetlike piece 129 will be disposed next to, and will be substantially coextensive with the first short side 125 of the bottom 121; the long side 129d of the sheetlike piece 129 will extend transversely across the bottom 121 and centrally thereof; the short side 129*a* of the sheetlike piece 129 will be disposed next to, and will extend to approximately the midpoint of the long side 128 of the bottom 121; and the short side 129*c* of the sheetlike piece 129 will be disposed next to, and will extend to approximately the midpoint of the long side 127 of the bottom 121**.

The first tubular body 122 and the bottom 121 of the container 120 are permanently secured to one another along the short side 125 of the bottom 121 by staples, not shown, or by the application of an adhesive, not shown, to the outside of the portion of the long side **129*b* of the sheetlike piece 129 which is overlapped by the short side 125 of the bottom 121 and/or by the application of an adhesive to the inside of the short side 125 of the bottom 121, or in any other conventional manner. The other sides of the first tubular body 122, namely the short side 129*a* and the shortside 129*c*, are unsecured to, and are free to move or float with respect to the sides of the bottom 121 that they are disposed next to, namely the long sides 128 and 126, respectively, and the movement of the short side 129*a* and the short side 129*c* toward the long side 129*b* will be effective to move the long side 129*d* toward the long side 129*b***.

The second tubular body 123 is formed from a second sheetlike piece 133 joined end to end, with an overlapped joint 134 between the joined ends of the pieces 133. The second sheetlike piece 133 is scored or otherwise deformed along a pair of vertical lines 135 and 136 in opposed sides thereof to permit it to be collapsed upon itself as is shown in FIGS. 11 and 12, the second sheetlike piece 133 also being scored or otherwise deformed along vertical lines at its corners to permit it to be formed into the illustrated tubular configuration. When the second tubular body 123 is fully erected, as is shown in FIG. 8, its configuration in a horizontal plane is generally rectangular with an opposed pair of short sides **133*a* and 133*c*, the sides which, respectively, contain the vertical lines 135 and 136, and with an opposed pair of long sides 133*b* and 133*d*, respectively. When the second tubular body 123 is fully erected, the long side 133*d* of the sheetlike piece 133 will be disposed next to, and will be substantially coextensive with the second short side 126 of the bottom 121; the long side 133*b* of the sheetlike piece 133 will extend transversely across the bottom 121 and centrally thereof; the short side 133*a* of the sheetlike piece 133 will be disposed next to, and will extend to approximately the midpoint of the long side 128 of the bottom 121; and the long side 133*c* of the sheetlike piece 133 will be disposed next to, and will extend to approximately midpoint of the long side 127 of the bottom 121**.

The second tubular body 123 and the bottom 121 of the container 120 are permanently secured to one another along the short side 126 of the bottom 121 by staples, not shown, or by the application of an adhesive, not shown, to the outside of the portion of the long side 133d of the sheetlike piece 133 which is overlapped by the short side 126 of the bottom 121 and/or by the application of an adhesive to the inside of the short side 126 of the bottom 121, or in any other conventional manner. The other sides of the second tubular body 123, namely the short side **133*a* and the short side 133*c* are free to move or float with respect to the sides of the bottom 121 that they are disposed next to, namely the long sides 128 and 127, respectively, and the movement of the short side 133*a* and the short side 133*c* toward the long side 133*d* will be effective to move the long side 133*b* toward the long side 133*d***.

Figure 10:
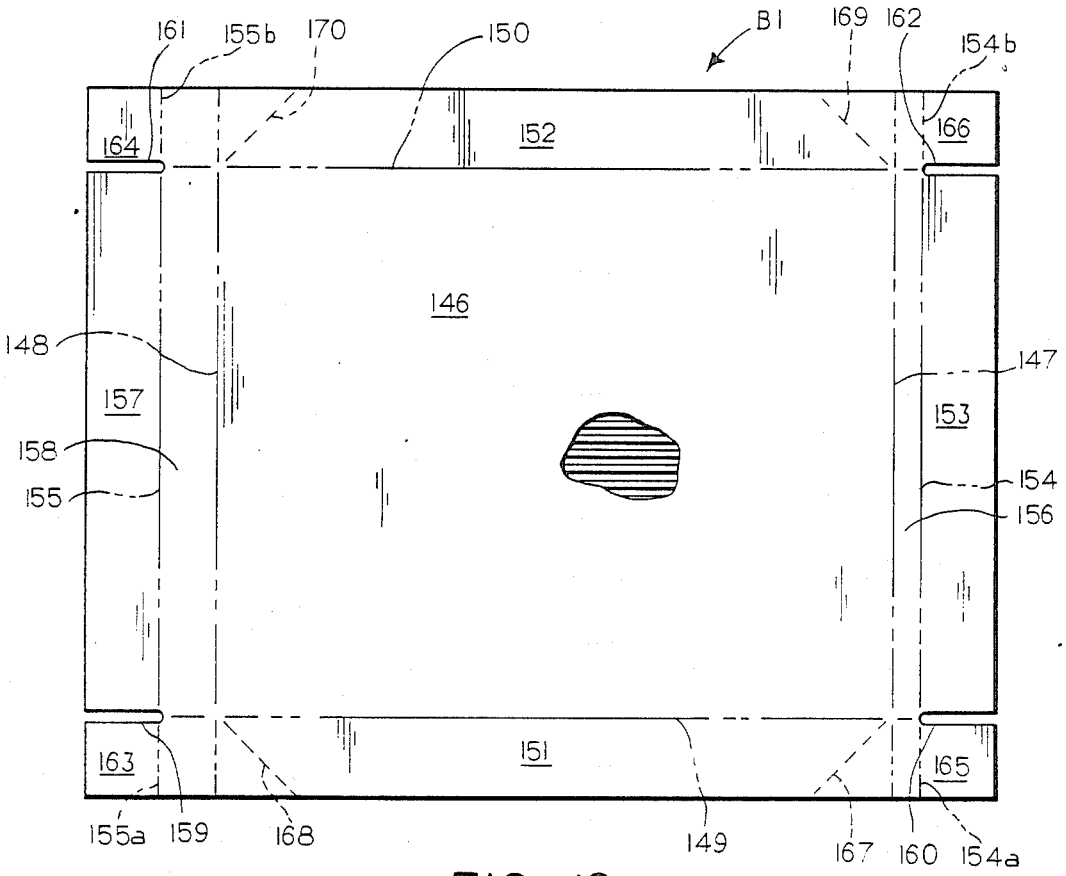
FIG. 10 is a view similar to FIG. 4 of a blank for use in forming one of the elements of the shipping container depicted in FIGS. 7 through 9.

FIG. 10 illustrates a special blank B1 from which the bottom 121 of the container 120 is formed. The blank B1 has a rectangular panel 146 which forms a horizontally disposed lowermost portion of the bottom 121 of the container 120. The rectangular panel 146 is disposed generally centrally within the outline of the blank B1, which also is generally of rectangular configuration, and the rectangular panel 146 is separated from the remaining portions of the blank B1 by fold lines 147 and 148 along the short sides of the rectangular panel 146 and by fold lines 149 and 150 along the long sides of the rectangular panel, the fold lines 147, 148, 149, and 150 being formed by deforming the blank B1 by scoring, slit scoring or otherwise, as is known in the art. By the scoring of the blank B1 along the fold lines 149 and 150 there is formed therein first and second long side panels 151 and 152, respectively. The blank B1 is also scored along a fold line 154 which is spaced from and extends parallel to the fold line 147, the fold line 154 forming a first short panel 153 and a first intermediate panel 156 between the fold line 147 and the fold line 154. Similarly, the blank B1 is scored along a fold line 155 which is spaced from and extends parallel to the fold line 148, the fold line 155 forming a second short panel 157 and a second intermediate panel 158 between the fold line 148 and the fold line 155. The blank B1 is also cut or slotted along the extensions beyond the fold lines 149 and 150 that lie beyond the ends of the rectangular panel 146 to form slots 159 and 160 at the ends of the fold line 149 and slots 161 and 162 at the ends of the fold line 150. While the slots 160 and 162 are shown as extending from the free edge of the blank B1 to the fold line 154, it is preferable in certain embodiments of the invention for them to extend only to the fold line 147. Similarly, while the slots 159 and 161 are shown as extending from the free edge of the blank B1 to the fold line 155, it is preferable in certain of the embodiments of the invention for them to extend only to the fold line 148. In any case, the blank B1 is also scored along the extensions of the fold line 155 beyond the cuts or slots 159 and 161, as shown at **155*a* and 155*b*, respectively, and corner locking flaps 163 and 164 are formed in corners of the blank B1 by the slot 159 and the fold line extension 155*a*, and by the slot 161 and the fold line extension 155*b*. Thus, the second short side 126 and the first and second long sides 127 and 128 of the bottom 121 of the container 120 are formed by folding the first long side panel 151 and the second long side panel 152 to extend normally with respect to the rectangular panel 146, by folding the second short side panel 157 to extend normally with respect to the intermediate panel 158, by inwardly folding the corner locking flaps 163 and 164 to overlie the end portions of the second short side panel 157 and by securing the corner locking flaps 163 and 164 to the portions of the second short side panel 157** by an adhesive or by stabples, not shown.

The fold line 154 is also scored along the extension **154*a* and 154*b* which lie beyond the cuts or slots 160 and 162, thereby forming corner locking flaps 165 and 166 in the other corner of the blank B1 by the fold line extension 154*a* and the slot 160, and by the fold line extension 154*b* and the slot 162, respectively. Thus, the first short side 125 of the bottom 121 of the container 120 is formed by folding the first short panel 153 along the fold line 154 to extend normally with respect to the intermediate panel 156, by inwardly folding the corner locking flaps 165 and 166 to overlie the end portions of the first short panel 153 and by securing the corner locking flaps 165 and 166 to the portions of the first short panel 153** by an adhesive or by staples, not shown.

The space between the fold line 147 and the fold line 154 is, preferably, slightly greater than the collapsed thickness of the first tubular body 122 of the container 120 so that the end area of the collapsed tubular body 122 can be contained entirely within the outline of the intermediate panel 156. This will permit the collapsed first tubular body 122 and the first intermediate panel 156 to be folded along the fold line 147 to lie along the rectangular panel 146 of the bottom 121 of the container 120. Further, the space between the fold line 148 and the fold line 155 is, preferably, slightly greater than the combined collapsed thickness of the first tubular body element 122 and the second tubular body element 123 of the container 120 so that the combined end areas of the collapsed first tubular body element and the collapsed second tubular body element can be contained entirely within the outline of the second intermediate body panel 158. This will permit the collapsed second tubular body element 123 to be folded along the fold line 148 to lie along the collapsed first tubular body element 122 of the container 120 to permit the container 120 to be collapsed in a neat, compact configuration, as is shown in FIG. 11, for ease of storage and shipment to the packing plant for the first use thereof or, in the case of a reusable container 120, for the return shipment for reuse thereof. For optimum collapsibility the first long side panel 151 is provided with first and second diagonal fold lines 167 and 168 extending, respectively, from the fold lines 147 and 148 in a converging manner at a 45° angle to the fold line 149 to the nearby free edge of the blank B1, the diagonal fold lines 167 and 168 preferably being formed in the underside of the blank B1, and, similarly, the second long side panel 152 is provided with first and second diagonal fold lines 169 and 170 extending, respectively, from the fold lines 147 and 148 in a converging manner at a 45° angle to the fold line 150 to the other edge of the blank B1, the diagonal fold lines 169 and 170 also, preferably, being formed in the underside of the blank B1. The diagonal fold lines 167 and 168 permit the portion of the first long side panel 151 between such diagonal fold lines to be folded inwardly to overlie the rectangular panel 146 when the container 120 is collapsed, and, similarly, the diagonal fold lines 169 and 170 permit the portion of the second long side panel 152 therebetween to be folded inwardly to overlie the rectangular panel 146 when the container 120 is collapsed, as is clear from FIG. 12.

The container 120 can be used with a standard wood or plastic pallet, not shown, for example, by stapling the rectangular panel 146 of the bottom 121 of the cotnainer 120 to such pallet or simply by placing or strapping the containers on such pallet. However, the container 120 is not restricted to use with a pallet even in the case of a large container that is adapted to contain heavy loads, for example, a container whose short sides 125 and 126 are each 40" and whose long sides 127 and 128 are each 48", a container size which would be well-suited for use with a standard 40"×48" pallet, because such a container could be handled by standard forklift handling equipment, without being attached to a pallet, for example, by inserting a slip sheet (not shown) thereunder, as is known in the art. While the container 120 as heretofore described has an open top, such open top can, of course, be closed by a separate inverted, telescoping tray-type cover or other cover, not shown, as is known in the art, or it can be closed by flaps that are integrally attached to the first and second tubular body elements 122 and 123, as is also known in the art. The blank B1 and the first and second sheetlike pieces 129 and 123 of the first and second tubular body elements 122 and 123, respectively, are each preferably formed from a heavy load bearing grade of corrugated fiberboard, for example, from heavy singlewall corrugated fiberboard or, preferably, for large containers, such as pallet size 40"×48" containers, from doublewall corrugated fiberboard or even, in certain cases, from triplewall corrugated fiberboard, especially if such large containers are designed to be reusable. Of course, the bottom 121 of the container 120 and the first and second tubular body elements 122 and 123 thereof experience different loads in service. Hence, the grade of corrugated fiberboard that is used in the blank b1 is not necessarily the same as the grade that is used in the first and second sheetlike pieces 129 and 133.

While the container of the present invention has been described as having the configuration of a rectangle with sides of an unequal length, a configuration which is preferred because it matches the configuration of many pallet sizes and types, it is also contemplated that, in both of the illustrated embodiments, the container can have the configuration of a rectangle with sides of an equal length, for example, the configuration of a square. Additionally, while the container has been described as having the collapsible body elements attached to the opposed short sides of a tray-type bottom whose configuration is that of a rectangle with sides of an unequal length, it is also contemplated that, in both of the illustrated embodiments, the collapsible body elements can also be attached to the opposed long sides of such a tray-type bottom. So long as the height of the collapsible body elements does not exceed the length of the short sides of the tray-type bottom in any such an arrangement, the collapsed body elements will still fit entirely within the perimeter of the bottom panel of the tray-type bottom.

Although the best mode contemplated by the inventor for carrying out the present invention as of the filing date hereof has been shown and described herein, it will be apparent to those skilled in the art that suitable modifications, variations, and equivalents may be made without departing from the scope of the invention, such scope being limited solely by the terms of the following claims.

What is claimed is:

1. A collapsible bulk shipping container comprising:

a tray-type bottom, said tray-type bottom having:

a rectangular bottom panel, said rectangular bottom panel having a first pair of opposed, 5. spaced-apart edges and a second pair of opposed, spaced-apart edges, said second pair of opposed, spaced-apart edges extending transversely between said first pair of opposed, spaced-apart edges;

a first pair of panel means, one of said 10. first pair of panel means being foldably attached to one of said first pair of opposed, spaced-apart edges of said rectangular bottom panel, at least a portion of said one of said first pair of panel means being foldable with respect to said rectangular bottom panel from a first position in which said at least a portion of said one of said first pair of panel means extends generally parallel to said rectangular bottom panel to a second position in which said at least a portion of said one of said first pair of panel means extends 20. generally normally from said rectangular bottom panel, at least a portion of the other of said first pair of panel means being foldably attached to the other of said first pair of opposed, spaced-apart edges of said rectangular bottom panel, said at least a portion of said other of said first pair of panel means being foldable with respect to said rectangular bottom panel from a first position in which said at least a portion of said other of said first pair of panel means extends generally parallel to said rectangular bottom panel to a second position in which said other of said at least a portion of said first pair of panel means extends generally normally from said rectangular bottom panel;

a second pair of panel means, one of said second pair of panel means being foldably attached to one of said second pair of opposed, spaced-apart edges of said rectangular bottom panel, said one of said second pair of panel means being foldable, with respect to said rectangular bottom panel, from a first position in which said one of said second pair of panel means extends generally parallel to said rectangular bottom panel to a second position in which said one of said second pair of panel means extends generally normally from said rectangular bottom panel, the other of said second pair of panel means being foldably attached to the other of said second pair of opposed, spaced-apart edges of said rectangular bottom panel;

a first intermediate panel, said first intermediate panel being directly foldably attached to one of said second opposed, spaced-apart edges of said rectangular bottom panel, one of said second pair of panel means being foldably attached to said one of said second pair of opposed, spaced-apart edges of said rectangular bottom panel by being foldably attached to said first intermediate panel, said one of said second pair of panel means being foldably attached to said first intermediate panel along a first intermediate fold line which is spaced from and which extends generally parallel to said one of said second pair of opposed, spaced-apart edges of said rectangular bottom panel, said first intermediate fold line and said one of said second pair of opposed, spaced-apart edges of said rectangular bottom panel forming a first space therebetween, said first space having a width extending between said first intermediate fold line and said one of said second pair of opposed, spaced-apart edges of said rectangular bottom panel; and a second intermediate panel, said second intermediate panel being directly foldably attached to the other of said second opposed, spaced-apart edges of said rectangular bottom panel, said other of said second pair of panel means being foldably attached to said other of said second pair of opposed, spaced-apart edges of said rectangular bottom panel by being foldably attached to said second intermediate panel, said other of said second pair of panel means being foldably attached to said second intermediate panel along a second intermediate fold line which is spaced from and which extends generally parallel to said other of said second pair of opposed, spaced-apart edges of said rectangular bottom panel, said second intermediate fold line and said other of said second pair of opposed, spaced-apart edges of said rectangular bottom panel forming a second space therebetween, said second space having a width extending between said second intermediate fold line and said other of said second pair of opposed, spaced-apart edges of said rectangular bottom panel; and a pair of body segments, each of said pair of body segments being telescoped within said tray-type bottom and further being collapsible from a first, open configuration in which said pair of body segments form, with one another, a tubular structure having a rectangular configuration to a second, collapsed configuration, each of said pair of body segments having:

a first side having first and second spaced-apart edges, said first side being disposed adjacent to, and being substantially coextensive with, one of said second pair of panel means of said tray-type bottom, said first side of one of said pair of body segments being secured to said one of said second pair of panel means of said tray-type bottom, said first side of the other of said pair of body segments being secured to the other of said second pair of panel means of said tray-type bottom; and second and third sides, the second side of each of said pair of body segments being foldably attached to one of said first and second spaced-apart edges of said first side of said each of said pair of body segments, the third side of each of said pair of body segments being foldably attached to the other of said first and second spaced-apart edges of said first side of said each of said pair of body segments, each of the second and third sides of each of said pair of body segments being foldable with respect to said first side of said each of said pair of body segments between a first position in which said each of said second and third sides extends generally perpendicularly to said first side of said each of said pair of body segments and a second position in which said each of said second and third sides extends generally parallel to said first side of said each of said pair of body segments, each of said pair of body segments being foldable with respect to said rectangular bottom panel of said tray-type bottom between a first position in which said each of said pair of body segments extends generally perpendicularly to said rectangular bottom panel and a second position in which said each pair of body segments extends generally parallel to said rectangular bottom panel, said second and third sides of said each of said pair of body segments being in said second position with respect to said first side of said each of said pair of body segments when said each of said pair of body segments is in said second position with respect to said tray-type bottom.

2. A collapsible bulk shipping container according to claim 1 in which said tray-type bottom is formed from a unitary blank of a foldable sheetlike material.

3. A collapsible bulk shipping container according to claim 2 in which said foldable sheetlike material is corrugated fiberboard.

4. A collapsible bulk shipping container according to claim 3 in which each of said pair of body segments is integrally formed from a second foldable sheetlike material.

5. A collapsible bulk shipping container according to claim 4 in which said second foldable sheetlike material is corrugated fiberboard.

6. A collapsible bulk shipping container according to claim 5 in which said corrugated fiberboard is multiwall corrugated fiberboard.

7. A collapsible bulk shipping container according to claim 1 wherein the second side of one of said pair of body segments at least partially overlies the second side of the other of said pair of body segments when said second side of said one of said pair of body segments is in said first position with respect to the first side of said one of said pair of body segments and said second side of said other of said pair of body segments is in said first position with respect to the first side of said other of said pair of body segments, whereby said tubular structure has at least a partial double thickness along one of its sides in said rectangular configuration.

8. A collapsible bulk shipping container according to claim 7 wherein the third side of one of said pair of body segments at least partially overlies the third side of the other of said pair of body segments when said third side of said one of said pair of body segments is in said first position with respect to the first side of said one of said pair of body segments and said third side of said other of said pair of body segments is in said first position with respect to the first side of said other of said pair of body segments, whereby said tubular structure has at least a partial double thickness along a second of its sides in said rectangular configuration.

9. A collapsible bulk shipping container according to claim 8 wherein said second of said sides in said rectangular configuration is spaced from and extends generally parallel to said one of said sides in said rectangular configuration.

10. A collapsible bulk shipping container according to claim 9 wherein said rectangular configuration has third and fourth sides, said third and fourth sides being spaced-apart and extending transversely of said second of said sides in said rectangular configuration, each of said second and third sides in said rectangular configuration being shorter than said second of said sides in said rectangular configuration.

11. A collapsible bulk shipping container according to claim 1 in which each of said first pair of panel means of said tray-type bottom comprises:

first and second spaced-apart diagonal score line means therein to permit the portion of said each of said first pair of panel means between said first and second spaced-apart diagonal fold lines to be folded inwardly into a position in which said portion extends generally parallel to said rectangular bottom panel of said tray-type bottom when each of said pair of body segments is folded into said second position with respect to said rectangular bottom panel of said tray-type bottom.

12. A collapsible bulk shipping container according to claim 1 wherein the width of one of said first space and said second space is at least approximately equal to the thickness of the first side of the one of said pair of body segments that is secured to the one of said second pair of panel means that is connected to the one of said first intermediate panel and said second intermediate panel that forms said one of said first space and said second space plus the thickness of the second side of said one of said pair of body segments plus the thickness of the third side of said one of said pair of body segments.

13. A collapsible bulk shipping container according to claim 12 wherein the width of the other of said first space and said second space is at least approximately equal to the width of said one of said first space and said second space plus the thickness of the first side of the other of said pair of body segments plus the thickness of the second side of said other of said pair of body segments plus the thickness of the third side of said other of said pair of body segments.

14. A collapsible bulk shipping container according to claim 1 in which each of said first pair of panel means of said tray-type bottom comprises:

first and second spaced-apart diagonal score line means therein to permit the portion of said each of said first pair of panel means between said first and second spaced-apart diagonal fold lines to be folded inwardly into a position in which said portion extends generally parallel to said rectangular bottom panel of said tray-type bottom when each of said pair of body segments is folded into said second position with respect to said rectangular bottom panel of said tray-type bottom.

15. A unitary blank for forming a tray-type bottom of a collapsible bulk shipping container, said blank being generally rectangular in configuration and comprising:

a rectangular bottom panel, said rectangular bottom panel having a first pair of opposed spaced-apart edges and a second pair of opposed, spaced-apart edges, said second pair of opposed, spaced-apart edges extending transversely between said first pair of opposed, spaced-apart edges;

a first intermediate panel foldably attached to said rectangular bottom panel along one of said first pair of opposed spaced-apart edges and said second pair of opposed, spaced-apart edges;

first wall panel means foldably attached to said first intermediate panel along a first fold line that is spaced from and extends generally parallel to said one of said first pair of opposed spaced-apart edges and said second pair of opposed, spaced-apart edges;

a second intermediate panel foldably attached to said rectangular bottom panel along the other of said one of said first pair of opposed spaced-apart edges and said second pair of opposed, spaced-apart edges;

second wall panel means foldably attached to said second intermediate panel along a second fold line that is spaced from and extends generally parallel to said other of said one of said first pair of opposed, spaced-apart edges and said second pair of opposed, spaced-apart edges;

third and fourth wall panel means foldably attached, respectively, to the first and second opposed, spaced-apart edges of the other of said first pair of opposed, spaced-apart edges and said second pair of opposed, spaced-apart edges;

each of said first, second, third and fourth wall panel means being foldable with respect to said rectangular bottom panel from a first position which is generaly in alignment with said rectangular bottom panel to a second position which is generally normal to said rectangular bottom panel, said first, second, third and fourth wall panel means being adapted to form a perimetrical wall surrounding said rectangular bottom panel when said each of said first, second, third and fourth wall panel means is folded with respect to said rectangular bottom panel to said second position; and means for securing said first, second, third and fourth wall means to one another in an end to end array to form said perimetrical wall when said each of said first, second, third and fourth wall panel means has been folded with respect to said rectangular bottom panel to said second position.

16. A unitary blank according to claim 15 in which said unitary blank is formed of a foldable, sheetlike material.

17. A unitary blank according to claim 16 in which said foldable sheetlike material is corrugated fiberboard.

18. A unitary blank according to claim 15 wherein there is a first distance between said first intermediate panel and said one of said first pair of opposed, spaced-apart edges and said second pair of opposed, spaced-apart edges, wherein there is a second distance between said second intermediate panel and said other of said one of said first pair of opposed, spaced-apart edges and said second pair of opposed, spaced-apart edges and wherein one of said first distance and said second distance is approximately twice as great as the other of said first distance and said second distance.

19. A unitary blank according to claim 15 in which said third wall panel means and said fourth wall panel means are each provided with first and second spaced-apart diagonal score line means therein to permit the portion between said first and second spaced-apart diagonal score line means of said each of said one of said third and fourth wall panel means to be folded inwardly to a third position overlying said rectangular bottom panel with respect to the remaining portions of said each of said third and fourth wall panel means when each of said third and fourth wall panel means has been folded to said second position.

20. A unitary blank according to claim 15 wherein each of said one of said first pair of opposed, spaced-apart edges and said second pair of opposed, spaced-apart edges has a substantially equal first length, and wherein each of said other of said first pair of opposed, spaced apart edges and said second pair of opposed, spaced-apart edges has a substantially equal second length, and wherein said second length is greater than said first length.

21. A collapsible bulk shipping container comprising:

a tray-type bottom, said tray-type bottom having:

a rectangular bottom panel, said rectangular bottom panel having a first pair of opposed, spaced-apart edges and a second pair of opposed, spaced-apart edges, said second pair of opposed, spaced-apart edges extending transversely between said first pair of opposed, spaced-apart edges;

a first pair of panel means, one of said first pair of panel means being foldably attached to one of said first pair of opposed, spaced-apart edges of said rectangular bottom panel, at least a portion of said one of said first pair of panel means being foldable with respect to said rectangular bottom panel from a first position in which said at least a portion of said one of said first pair of panel means extends generally parallel to said rectangular bottom panel to a second position in which said at least a portion of said one of said first pair of panel emans extends generally normally from said rectangular bottom panel, at least a portion of the other of said first pair of panel means being foldably attached to the other of said first pair of opposed, spaced-apart edges of said rectangular bottom panel, said at least a portion of said other of said first pair of panel means being foldable with respect to said rectangular bottom panel from a first position in which said at least a portion of said other of said first pair of panel means extends generally parallel to said rectangular bottom panel to a second position in which said other of said at least a portion of said first pair of panel means extends generally normally from said rectangular bottom panel; and a second pair of panel means, one of said second pair of panel means begin foldably attached to one of said second pair of opposed, spaced-apart edges of said rectangular bottom panel, said one of said second pair of panel means being foldable, with respect to said rectangular bottom panel, from a first position in which said one of said second pair of panel means extends generally parallel to said rectangular bottom panel to a second position in which said one of said second pair of panel means extends generally normally from said rectangular bottom panel, the other of said second pair of panel means being foldably attached to the other of said second pair of opposed, spaced-apart edges of said rectangular bottom panel; and a pair of collapsible tubular body segments, each of said pair of collapsible tubular body segments being telescoped within said tray-type bottom and further being collapsible from a first, open configuration in which said pair of collapsible tubular body segments form, with one another, a partitioned tubular structure having a rectangular configuration to a second, collapsed configuration, each of said pair of collapsible tubular body segments having:

first and second opposed sides, one of said first and second opposed sides having a first and second spaced-apart edges, said one of said first and second opposed sides being disposed adjacent to, and being substantially coextensive with, one of said second pair of panel means of said tray-type bottom, said one of said first and second opposed sides of one of said pair of collapsible tubular body segments being secured to said one of said second pair of panel means of said tray-type bottom, one of said first and second opposed sides of the other of said pair of collapsible tubular body segments being secured to the other of said second pair of panel means of said tray-type bottom, the other of said first and second opposed sides of said one of said pair of collapsible tubular body segments being movable toward said one of said first and second opposed sides of said one of said pair of collapsible tubular body segments upon the collapsing of said one of said pair of collapsible tubular body segments, the other of said first and second opposed sides of said other of said pair of collapsible tubular body segments being movable toward said other of said first and second opposed sides of said other of said pair of collapsible tubular body segments upon the collapsing of said other of said pair of collapsible tubular body segments;

second and third sides, the second side of one of said pair of collapsible tubular body segments being foldably attached to and extending between one of said first and second spaced-apart edges of one of said first and second opposed sides of said one of said pair of collapsible tubular body segments and one of said first and second spaced-apart edges of the other of said first and second opposed sides of said one of said pair of collapsible tubular body segments, the third side of said one of said pair of collapsible tubular segments being foldably attached to and extending between the other of said first and second spaced-apart edges of said one of said first and second opposed sides of said one of collapsible tubular body segments and the other of said first and second spaced-apart edges of the other of said first and second opposed sides of said one of said pair of collapsible tubular body segments, each of said second and third sides of said one of said pair of collapsible tubular body segments being foldable with respect to said first side of said one of said pair of collapsible tubular body segments between a first position in which said each of said second and third sides extends generally perpendicularly to said first side of said one of said pair of collapsible tubular body segments and a second position in which said one of said second and third sides extends generally parallel to said first side of said one of said pair of collapsible tubular body segments, the second side of the other of said pair of collapsible tubular body segments being foldably attached to and extending between one of said first and second spaced-apart edges of said one of said first and second opposed sides of said other of said pair of collapsible tubular body segments and one of said first and second spaced-apart edges of the other of said first and second opposed sides of said other of said pair of collapsible tubular body segments, the third side of said other of said pair of collapsible tubular body segments being foldably attached to and extending between the other of said first and second spaced-apart edges of said one of said first and second opposed sides of said other of said pair of collapsible tubular body segments and the other of said first and second spaced-apart edges of the other of said first and second opposed sides of said other of said pair of collapsible tubular body segments, each of said second and third sides of said other of said pair of collapsible tubular body segments being foldable with respect to said first side of said other of said pair of collapsible tubular body segments between a first position in which said each of said second and third sides extends generally perpendicularly to said first side of said other of said pair of collapsible tubular body segments, each of said pair of collapsible tubular body segments being foldable with respect to said rectangular bottom panel of said tray-type being between a first position in which said each of said pair of collapsible tubular body segments extends generally perpendicularly to said rectangular panel and a second position in which said each pair of collapsible tubular body segments extends parallel to said rectangular bottom panel, said second and third sides of said each of said pair of collapsible tubular body segments being in said second position with respect to said first side of said each of said pair of collapsible tubular body segments when said each of said pair of collapsible tubular body segments is in said second position with respect to said tray-type bottom.

22. A collapsible bulk shipping container according to claim 21 in which said tray-type bottom is formed from a unitary blank of a foldable sheetlike material.

23. A collapsible bulk shipping container according to claim 22 in which said foldable sheetlike material is corrugated fiberboard.

24. A collapsible bulk shipping container according to claim 23 in which each of said pair of collapsible tubular body segments is integrally formed from a second foldable sheetlike material.

25. A collapsible bulk shipping container according to claim 24 in which said second foldable sheetlike material is corrugated fiberboard.

26. A collapsible bulk shipping container according to claim 25 in which said corrugated fiberboard is multiwall corrugated fiberboard.

27. A collapsible bulk shipping container according to claim 21 wherein said tray-type bottom also has:

a first intermediate panel, said first intermediate panel being directly foldably attached to one of said second opposed, spaced-apart edges of said rectangular bottom panel, one of said second pair of panel means being foldably attached to said one of said second pair of opposed, spaced-apart edges of said rectangular bottom panel by being foldably attached to said first intermediate panel, said one of said second pair of panel means being foldably attached to said first intermediate panel along a first intermediate fold line which is spaced from and which extends generally parallel to said one of said second pair of opposed, spaced-apart edges of said rectangular bottom panel, said first intermediate fold line and said one of said second pair of opposed, spaced-apart edges of said rectangular bottom panel forming a first space therebetween, said first space having a width extending between said first intermediate fold line and said one of said second pair of opposed, spaced-apart edges of said rectangular bottom panel; and a second intermediate panel, said second intermediate panel being directly foldably attached to the other of said second opposed, spaced-apart edges of said rectangular bottom panel, said other of said second pair of panel means being foldably attached to said other of said second pair of opposed, spaced-apart edges of said rectangular bottom panel by being foldably attached to said second intermediate panel, said other of said second pair of panel means being foldably attached to said second intermediate panel along a second intermediate fold line which is spaced from and which extends generally parallel to said other of said second pair of opposed, spaced-apart edges of said rectangular bottom panel, said second intermediate fold line and said other of said second pair of opposed, spaced-apart edges of said rectangular bottom panel forming a second space therebetween, said second space having a width extending between said second intermediate fold line and said other of said second pair of opposed, spaced-apart edges of said rectangular bottom panel.

28. A collapsible bulk shipping container according to claim 27 wherein the width of one of said first space and said second space is at least approximately equal to the thickness of the first side of the one of said pair of collapsible tubular body segments in its second, collapsed configuration plus the thickness of the other of said pair of collapsible tubular body segments.

29. A collapsible bulk shipping container according to claim 28 wherein the width of the other of said first space and said second space is at least approximately equal to the thickness of one of said pair of collapsible tubular body segments plus.

30. A collapsible bulk shipping container according to claim 21 in which each of said first pair of panel means of said tray-type bottom comprises:

first and second spaced-apart diagonal score line means therein to permit the portion of said each of said first pair of panel means between said first and second spaced-apart diagonal fold lines to be folded inwardly into a position in which said portion extends generally parallel to said rectangular bottom panel of said tray-type bottom when each of said pair of body segments is folded into said second position with respect to said rectangular bottom panel of said tray-type bottom.

31. A unitary blank according to Claim 18 in which said third wall panel means and said fourth wall panel means are each parallel with first and second spaced-apart diagonal score line means therein to permit the portion between said first and second spaced-apart diagonal score line means of said each of said one of said third and fourth wall panel means to be folded inwardly to a third position overlying said rectangular bottom panel with respect to the remaining portions of said each of said third and fourth wall panel means when each of said third and fourth wall panel means has been folded to said second position.

32. A collapsible bulk shipping container according to claim 27 in which each of said first pair of panel means of said tray-type bottom comprises:

first and second spaced-apart diagonal score line means therein to permit the portion of said each of said first pair of panel means between said first and second spaced-apart diagonal fold lines to be folded inwardly into a position in which said portion extends generally parallel to said rectangular bottom panel of said tray-type bottom when each of said pair of body segments is folded into said second position with respect to said rectangular bottom panel of said tray-type bottom.

* * * * *